United States Patent [19]

Loiseau et al.

[11] Patent Number: 4,597,406

[45] Date of Patent: Jul. 1, 1986

[54] DEVICE FOR SUPPLYING A PIPE WITH A FLUID AT A PARTICULAR PRESSURE FROM ALTERNATIVE SOURCES

[75] Inventors: Gérard Loiseau, Bois D'Arcy; Maurice Molozay, Le Mesnil-Saint-Denis; Michel Rigo, Lozanne, all of France

[73] Assignee: L'Air Liquide, Societe Anonyme pour l'Etude et l'Exploitation des Procedes Georges Claude, Paris, France

[21] Appl. No.: 598,750

[22] Filed: Apr. 10, 1984

[30] Foreign Application Priority Data

Apr. 11, 1983 [FR] France ..... 83 05859

[51] Int. Cl.[4] ..... F17C 13/04

[52] U.S. Cl. ..... 137/113

[58] Field of Search ..... 137/113; 222/6, 66, 222/145

[56] References Cited

U.S. PATENT DOCUMENTS

| | | | |
|---|---|---|---|
| 2,641,273 | 6/1953 | Siebens | 137/113 |
| 2,741,257 | 4/1956 | Edwards | 137/113 |
| 2,768,640 | 10/1956 | Zimmer et al. | 137/113 |
| 3,428,072 | 2/1969 | Welch | 137/113 |
| 3,890,992 | 6/1975 | Wolz et al. | 137/487.5 |

FOREIGN PATENT DOCUMENTS

| | | | |
|---|---|---|---|
| 1257176 | 12/1967 | Fed. Rep. of Germany . | |
| 2441886 | 11/1976 | Fed. Rep. of Germany | 137/113 |
| 2206280 | 6/1974 | France . | |
| 1105724 | 3/1968 | United Kingdom | 137/113 |

*Primary Examiner*—Robert G. Nilson

*Attorney, Agent, or Firm*—Young & Thompson

[57] ABSTRACT

An installation for the delivery of a gas of high purity under a constant pressure from either of two vessels each of which is connected to a utilization outlet via a separate supply pipe and a switching system. A switching control system acts on two high-pressure valves, one for each vessel, downstream of which is situated a single pressure regulator which controls the outlet gas pressure. The valves are actuated by an auxiliary low-pressure gas via a pneumatic memory and two detectors measuring the pressure prevailing in the two gas vessels.

14 Claims, 1 Drawing Figure

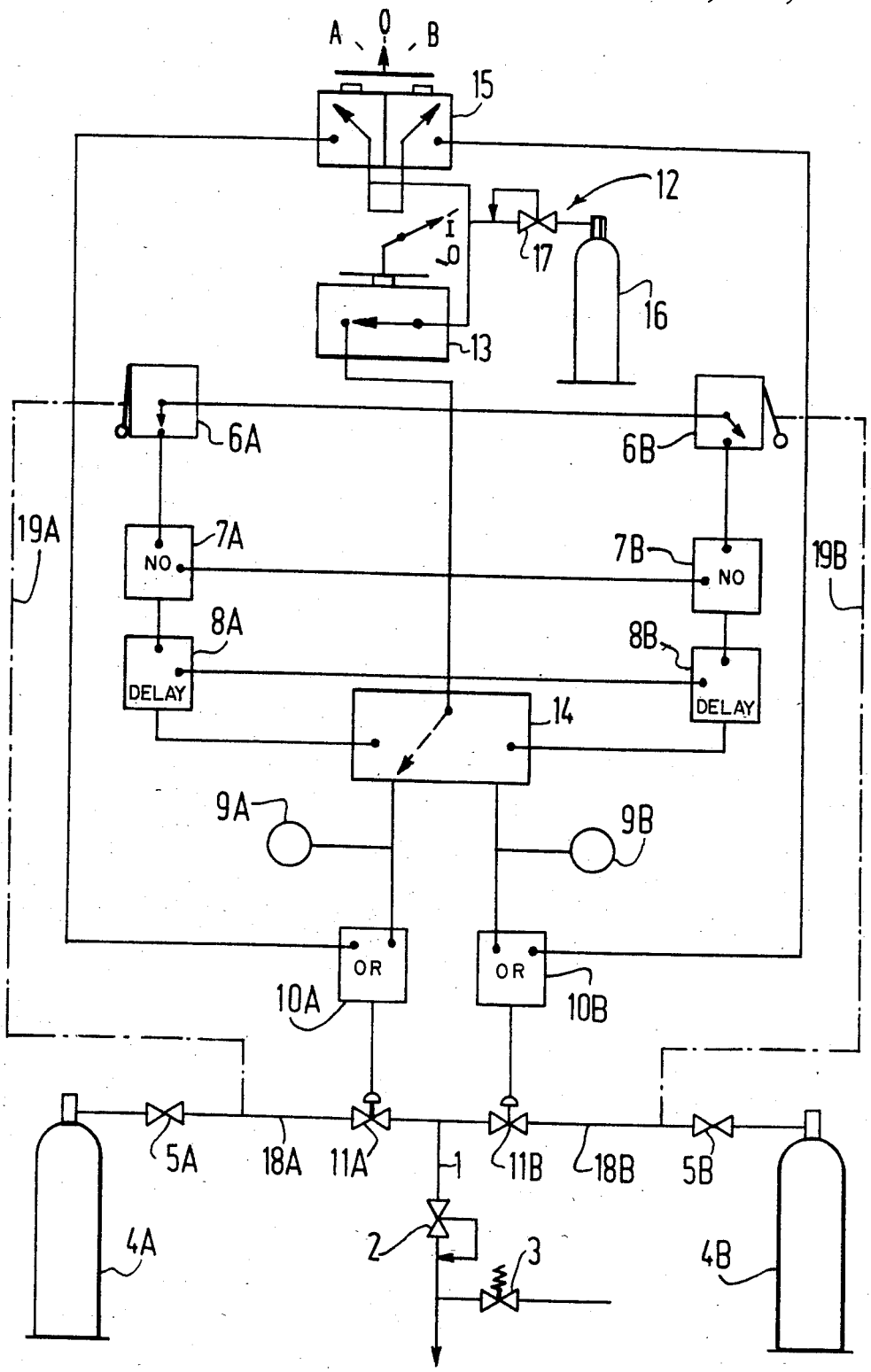
A
0
B
15
12
17
16
13
6A
6B
19A
19B
7A
7B
NO
NO
8A
8B
DELAY
DELAY
14
9A
9B
OR
OR
10A
10B
5A
18A
11A
1
11B
18B
5B
4A
2
3
4B

DEVICE FOR SUPPLYING A PIPE WITH A FLUID AT A PARTICULAR PRESSURE FROM ALTERNATIVE SOURCES

BACKGROUND OF THE INVENTION

The present invention relates to devices known under the title "automatic distribution units", meaning devices serving the purpose of supplying a pipe with a fluid at a particular pressure coming from two vessels, of which one is operative whilst the other is on standby. These devices commonly comprise distributor means arranged to place one or the other of the two vessels in communication with the said pipe, means for switching the distributor means sensitive to the degree of filling of the vessel in operation, and pressure regulator means delivering the fluid under the utilisation pressure.

In known devices of this kind, intended for supplying gas from two high-pressure bottles, the distributor means and their switching means are combined into a mechanical apparatus comprising a slide valve submitted to two opposed pressures. An arrangement of this nature necessitates the installation of pressure regulator means upstream of this apparatus, which leads to a definite number of disadvantages. In particular:

the reliability of the switching operation is not absolute, since switchover depends on very small pressure differences, which may experience difficulties in overcoming mechanical resistances, for example those of friction sealing joints, for the same reason, it is difficult to govern the switching pressure and the delivery pressure is not perfectly stable during reversing actions, whilst one vessel is on standby, the pressure regulator allocated to this vessel remains idle, without gaseous scavenging. This may raise problems during reversing actions, particularly in the case of a corrosive gas.

The invention has as its object to provide an automatic unit which is completely reliable, controllable with precision and able to assure a stable pressure during reverse switching actions.

SUMMARY OF THE INVENTION

To this end, the invention provides a device for supplying a utilisation pipe with a fluid under a particular pressure coming from either of two vessels, each of which is connected to the utilisation pipe via a respective supply pipe, said device comprising two switches associated respectively with the two vessels and sensing the degree of filling of these vessels, a pressure regulator situated in the said utilisation pipe, submitted at its inlet to the pressure prevailing in the vessel in operation and arranged to deliver the fluid at its outlet under the said particular pressure, a shut-off valve inserted in each of the supply pipes and switching means controlling the two shut-off valves and actuated by the said switches.

According to other advantageous features the device according to the invention may comprise an auxilliary power source acting to operate the said switching means and connected to these via the said switches. Moreover, a delay element may be interposed between each switch and the switching means. Furthermore, the device may also comprise manually operated means overriding the switching means.

BRIEF DESCRIPTION OF THE DRAWINGS

An embodiment of the invention will now be described with reference to the accompanying drawings, in which the single FIGURE diagrammatically illustrates a gas distributor plant equipped with a control device according to the invention.

DESCRIPTION OF THE PREFERRED EMBODIMENT

The gas distribution plant illustrated in the drawing is intended to supply a gas contained in two bottles 4A and 4B, which may in practice each consist of a set of bottles combined within a rack or frame, to a utilisation pipe 1 equipped with an expansion valve or pressure regulator 2 and with a safety valve 3.

The plant comprises a particular number of duplicated pneumatic components corresponding to the two bottles 4A and 4B. In the following description, these pairs of components will be denoted by one and the same reference, but carrying the suffix A or B depending on whether they are allocated to the one bottle or the other. These components are: two stop valves 5A,5B situated at the outlet orifices of the two bottles, two pressure sensitive detectors 6A,6B, two logic NO units 7A,7B, two delay units 8A,8B, two penumatic indicators 9A,9B, two inclusive "OR" logic units 10A,10B, and two pneumatically controlled shut-off valves 11A,11B.

The plant also comprises particular elements common to both circuits, which are: a source 12 of low-pressure gas, a manual two-position switch 13, a pneumatic memory 14 and an auxiliary three-position switch 15.

The elements 6 to 11 and 13 to 15 are pneumatic components well known in the art and available in the industry. As a result, it is sufficient to describe their functions.

The gas source 12 comprises a gas bottle 16 equipped with a pressure regulator 17, of which the outlet, under a pressure of 6 bars for example, is connected on the one hand in parallel with the input side of the switch 13, and on the other hand to the two inlets of the switch 15. Alternatively, the source 12 could consist of the supply of low-pressure air or of another gas of the user. The outlet of the switch 13 is connected to a first inlet of each of the components 6 to 8 and 14. The outlet of each stop valve 5 is connected via a supply pipe 18 to a first inlet of the associated pneumatically controlled valve 11, and the outlets of the two valves 11 are connected to the pipe 1 upstream of the pressure regulator 2.

Each detector 6 has a second inlet or control inlet connected to the associated pipe 18, between the valve 5 and the valve 11 via a pipe 19 illustrated in chain lines. When the pressure in this pipe 19 exceeds a predetermined threshold, the first inlet of the detector is connected to its outlet which is connected to a second inlet or control inlet of the associated logic NO unit 7.

Each logic NO unit 7 interconnects its first inlet and its outlet in the absence of a pneumatic signal at its second inlet, and interrupts this connection as soon as a pneumatic signal is received at its second inlet. The outlet of the logic NO unit 7 is connected to a second inlet or control inlet of the associated delay element 8.

Each delay element 8 interconnects its first inlet with its outlet upon receiving a pneumatic signal at its second inlet during a predetermined period. In the absence of a signal of this nature, or if the signal is shorter than this predetermined period, it interrupts this connection.

The memory 14 has two control inlets connected respectively to the outlets of the delay elements 8, and two outlets connected, respectively, to a first inlet of the logic OR units 10. The memory contains a two-position floating slider of which the extremities are respectively aligned with the two control inlets of the memory. In each position, this slider places the first inlet of the memory in communication with one of the two outlets. The slider does not change position unless a pneumatic signal appears at the control inlet corresponding to the change of position in question.

The second inlet of each logic OR unit 10 is connected to a corresponding outlet of the auxiliary switch, and its outlet is connected to the control element of the associated valve 11. A pneumatic signal appears at this outlet in the presence of a pneumatic signal at the one or other of the two inlets of the OR logic unit.

Each indicator 9A,9B is connected to the pipe which connects the logic respective OR unit 10A,10B to the corresponding outlet of the memory 14. The switch 13 has a position "I" in which its inlet is placed in communication with its outlet, and a position "O" in which this communication is interrupted. The switch 15 has a neutral "O" position in which neither of its outlets is placed in communication with the corresponding inlet, and two active positions "A" and "B" in each of which one inlet of this switch is placed in communication with the second inlet of the associated logic OR unit 10.

The operation of the arrangement thus described is the following. Let it first be assumed that the two bottles 4A,4B are full and contain the gas to be supplied under a high pressure, for example of 200 bars. The switch 13 is at the "O" position, as is the switch 15. Consequently, no component of the low-pressure circuit is supplied by the source 12, so that the two valves 11 are closed and that no gas flow issues via the pipe 1. The memory is at either of its two positions, for example as illustrated, that which places its first inlet in communication with the logic OR unit 10A.

Upon putting the plant in operation, the switch 13 is moved to its position "I", and the two stop valves 5 are then opened. The two detectors 6 exposed to a higher pressure than their threshold pressure, deliver a pneumatic signal at their outlets. Consequently, no signal appears at the outlets of the logic NO units 7, nor consequently at those of the delay units 8. The memory 14 thus remains in the same state it had been in previously, and the low-pressure gas which had opened the valve 11A via this memory and the logic OR unit 10A as soon as the switch 13 had been operated, keeps this valve 11A open constantly. The bottle 4A consequently feeds high-pressure gas into the pipe 1, and this gas is expanded by the expansion valve 2 to its operating pressure. The bottle 4B remains full, on standby. The indicator 9A shows that it is the bottle 4A which is in operation.

This situation remains until the pressure of the gas contained in the bottle 4A reaches the threshold pressure of the detector 6. The detector 6 then stops delivering a penumatic signal at its outlet, and a pneumatic signal consequently appears at the outlet of the logic NO unit 7A. After the predetermined delay period, for example of the order of 30 seconds, this causes the appearance of a pneumatic signal at the outlet of the delay element 8A and this signal repels the slider of the memory 14. The low-pressure gas fed to the first inlet of this memory then emerges via the other outlet and reaches the logic OR unit 10B and from there the valve llB.

Thus, the low-pressure supply to the valve llA is cut off and that to the valve 11B is established at the same time, which is verified by means of the indicators 9A and 9B. This closes the valve 11A and opens the valve 11B, and the bottle 4B is placed in operation. The stop valve 5A may then be closed, the bottle 4A may be replaced by a full bottle and the same stop valve may be opened again. For the reasons already stated, this does not alter the state of the memory 14 and a new reserve bottle is available without the supply to the pipe 1 having been cut off. Furthermore, if the threshold pressure of the detectors 6 is selected correctly as a function of the performance of the pressure regulator 2, no surge will be detectable downstream of this latter during switchover.

It will be apparent that the same actions recur when it is the turn of the bottle 4B to be drained sufficiently to reach the threshold pressure of the detectors 6.

If, for some reason (leakage, jamming of a component, etc. . . ) the switchover does not occur, the user is warned of this event by means of the pressure gauge normally provided on the bottle in operation, and possibly by a warning system, not illustrated. It is then possible to move the auxiliary switch 15 to its position A or B corresponding to the other bottle. The low-pressure gas then travels direct to the logic OR unit 10 associated with this latter and from there to the corresponding valve 11. A manual switchover is performed in this manner, without any disturbance as regards the supply to the pipe 1.

This installation has numerous advantages. In particular, it operates in wholly automatic manner, at a comparatively low cost, the direct utilisation of high pressure to control the switchover assures great sensitivity, high reliability and an extensive possiblity of adjustment, the gas delivery pressure remains stable during switching-over operations as already stated, the control circuit is wholly indpendent of the high-pressure circuit, and the pressure regulator 2 is scavenged constantly. This is an assurance against risks of contamination of the gas supplied, which is an appreciable assurance in the case of a gas of high purity, the presence of an auxiliary manual control circuit in parallel with the automatic control circuit is very advantageous for the user in applications in which it is out of the question to cut off the supply, as in the case of particular scientific applications.

Furthermore, by reason of the presence of the logic NO units 7, low-pressure gas only reaches the control inlets of the memory 14 during the short periods in which the pressure sensitive detectors 6 detect an inadequate pressure, that is to say during bottle change-over. The consumption of low-pressure gas is a minimum as a result.

It should equally be observed that the presence of the delay elements 8 provides considerable ease of operation for the following reason. After a stopping period, it is desirable to put the already partly emptied bottle back in operation in order to have a full bottle on standby. This function is provided automatically by the installation in accordance with the invention.

As a matter of fact, during a protracted stoppage (stop valves 5 closed), the pressure in the pipes 19 may drop because of leaks below the threshold of the detectors 6, so that these are "idle". Upon starting the following time, the switch 13 is initially operated; no signal appears at the outlet of the detectors and a pneumatic signal is consequently supplied by the two logic NO units 7. The delay period is sufficient to allow the opening of one or the other of the two stop valves 5, which sets off the two detectors 6 and consequently suppresses the output signal of the logic NO units. In this manner, neither of the delay elements provides an output signal and the memory remains in its initial condition, whatever the opening sequence of the valves 5.

This remains valid if the pressure has dropped in only one of the two pipes 19 and if no leak had occurred, there is no risk of the state of the memory 14 having changed.

It will be observed moreover that the plant described in the foregoing is completely pneumatic. Consequently, it provides total safety in environments in which sparking risks are prohibited. Its compact nature facilitates its servicing.

As a modification, in the case in which the bottles 4A and 4B contain an inert gas such as nitrogen or $CO_2$, the auxiliary bottle 16 may be replaced by a take off from the pipes 18. The plant is then completely independent.

The invention may equally be utilised in the case in which the bottles 4A and 4B contain a liquified gas or even a liquid intended to be distributed in liquid form. The detectors 6A,6B would then be replaced by switches responding to the level of the liquid in the two bottles.

I claim:

1. A device for supplying a utilization pipe with a fluid under a utilization low pressure, the fluid coming from either of two vessels initially containing said fluid under a high pressure, said device comprising, for each vessel: a supply pipe connecting the vessel to said utilization pipe; a shut-off valve mounted in said supply pipe; and a switch arranged to sense the degree of filling of the vessel; the device further comprising a single pressure regulator mounted in said utilization pipe, subjected at an inlet thereof to the pressure prevailing in the vessel supplying fluid and arranged to deliver the fluid at an outlet thereof under said utilization low pressure, switching means controlling the two shut-off valves and actuated via said switches, means for manually overriding the switching means, an auxiliary energy source serving the purpose of operating the said switching means and connected to the said switching means via the said switches, and for each vessel, an inclusive "OR" logic unit of which one inlet is connected to a corresponding outlet of said switching means, of which a second inlet is connected to a corresponding outlet of a three-position manual switch supplied by the said auxiliary energy source, and of which an outlet is connected to a control inlet of the corresponding shut-off valve.

2. A device according to claim 1, in which the said switches are detectors detecting the pressure prevailing in the vessels.

3. A device according to claim 1, in which the switching means incorporate two stable positions.

4. A device according to claim 1, further comprising an auxiliary energy source serving to actuate the said switching means and connected to the same via the said switches.

5. A device according to claim 1, in which it comprises indicator means indicating which vessel is in operation.

6. A device according to claim 1, in which said device incorporates exclusively pneumatic components.

7. A device for supplying a utilization pipe with a gas under a utilization low pressure, the gas coming from either of two vessels initially containing said gas under a high pressure, said device comprising, for each vessel: a supply pipe connecting the vessel to said utilization pipe; a shut-off valve mounted in said supply pipe; and a switch arranged to sense the internal pressure of the vessel; the device further comprising a single pressure regulator mounted in said utilization pipe, subjected at an inlet thereof to the pressure prevailing in the vessel supplying gas and arranged to deliver the gas at an outlet thereof under said utilization low pressure, switching means controlling the two shut-off valves and actuated via said switches, means for manually overriding the switching means, an auxiliary energy source serving the purpose of operating the said switching means and connected to the said switching means via the said switches, and for each vessel, an inclusive "OR" logic unit of which one inlet is connected to a corresponding outlet of said switching means, of which a second inlet is connected to a corresponding outlet of a three-position manual switch supplied by the said auxiliary energy source, and of which an outlet is connected to a control inlet of the corresponding shut-off valve.

8. A device according to claim 7, in which the switching means incorporate two stable positions.

9. A device according to claim 7, further comprising an auxiliary energy source serving to actuate the said switching means and connect to the same via the said switches.

10. A device according to claim 7, in which it comprises indicator means indicating which vessel is in operation.

11. A device according to claim 7, in which said device incorporates exclusively pneumatic components.

12. A device for supplying a utilization pipe with a fluid under a particular pressure coming from either of two vessles, each of which is connected to the utilization pipe via a respective supply pipe, said device comprising two switches associated respectively with the two vessels and sensing the degree of filling of these vessels, vessel in a pressure regulator situated in the said utilization pipe, operation and arranged to deliver the fluid at its outlet under the said particular pressure, a shut-off valve respectively inserted in each supply pipe, switching means controlling the two shut-off valves and actuated via the said switches, and an auxiliary energy source serving to actuate the said switching means and connected to the same via the said switches, an outlet of each said switch being connected to a first inlet of a logic NO unit of which a second inlet is connected to the said auxiliary energy source and of which an outlet is connected to the switching means.

13. A device for supplying a utilization pipe with a fluid under a particular pressure coming from either of two vessels, each of which is connected to the utilization pipe via a respective supply pipe, said device comprising two switches associated respectively with the two vessels and sensing the degree of filling of these vessels, a pressure regulator situated in the said utilization pipe, submitted at its inlet to the pressure prevailing in the vessel in operation and arranged to deliver the fluid at its outlet under the said particular pressure, a shut-off valve respectively inserted in each supply pipe, switching means controlling the two shut-off valves and actuated via the said switches, and a delay element inserted between each switch and the switching means.

14. A device for supplying a utilization pipe with a fluid under a particular pressure coming from either of two vessels, each of which is connected to the utilization pipe via a respective supply pipe, said device comprising two switches associated respectively with the two vessels and sensing the degree of filling of these vessels, a pressure regulator situated in the said utilization pipe, submitted at its inlet to the pressure prevailing in the vessel in operation and arranged to deliver the fluid at its outlet under the said particular pressure, a shut-off valve respectively inserted in each supply pipe, switching means controlling the two shut-off valves and actuated via the said switches, means for manually overriding the switching means, an auxiliary energy source serving the purposes of switching the said switching means connected to the said switching means via the said switches, and for each vessel, an inclusive "OR" logic unit of which one inlet is connected to a corresponding outlet of a three-position manual switch supplied by its said auxiliary energy source and of which an outlet is connected to a control inlet of the corresponding shut-off valve.

* * * * *